United States Patent [19]

Wilcox

[11] 4,091,652

[45] May 30, 1978

[54] APPARATUS FOR SHAPING METAL SHEETS

[75] Inventor: Clinton H. Wilcox, Romoland, Calif.

[73] Assignee: Alumax, Inc., San Mateo, Calif.

[21] Appl. No.: 763,366

[22] Filed: Jan. 28, 1977

[51] Int. Cl.[2] ..... B21D 11/10

[52] U.S. Cl. ..... 72/312; 72/315; 72/323; 72/400

[58] Field of Search ..... 72/312, 382, 381, 383, 72/384, 465, 320, 322, 323, 306, 380, 388, 319, 399, 400, 296, 314, 315; 113/1 D, 120 R

[56] References Cited

U.S. PATENT DOCUMENTS

| | | | |
|---|---|---|---|
| 1,954,737 | 4/1934 | Kowal | 113/1 D |
| 2,056,720 | 10/1936 | Glunz | 113/1 D |
| 2,771,670 | 11/1956 | Ruppert | 72/320 |
| 2,845,985 | 8/1958 | Green | 72/323 |
| 3,434,266 | 3/1969 | Wolf et al. | 113/1 R |
| 3,461,711 | 8/1969 | Ogilvie | 72/383 |
| 3,595,061 | 7/1971 | Bessbo | 72/383 |

FOREIGN PATENT DOCUMENTS

| | | | |
|---|---|---|---|
| 287,301 | 11/1952 | Switzerland | 72/400 |

*Primary Examiner*—Michael J. Keenan

[57] ABSTRACT

A device is disclosed for conforming a blank metal sheet, preferably aluminum, to the shape of a die which includes pressure means for holding the blank metal sheet firmly against the die surface while actuating cam members to conform the blank metal sheet into a final desired shape as defined by the die member.

3 Claims, 3 Drawing Figures

APPARATUS FOR SHAPING METAL SHEETS

BACKGROUND OF THE INVENTION

This invention relates to a device for shaping blank metal sheets, preferably aluminum, for use in the construction industry. The assignee of the present invention has been assigned copending U.S. application Ser. No. 749,480 filed Dec. 10, 1976 directed toward a durable exterior wall panel comprising corrugated panels of prepainted aluminum. Strips of insulative material are securedly attached to the inner side of the aluminum panels to substantially fill the voids formed by the corrugation. The panels are attached to one another and to a backing wall by nails or other attachment means which pass through the panel within the corrugated areas not in contact with the insulative backing. Prepainted exterior aluminum insert strips are snugly fit into the corrugated areas to cover from view the attachment means.

When faced with the fabrication of channelled aluminum panels from blank metal sheets, it was found that no currently available device was satisfactory in forming such channels. The corrugated areas in the aluminum panels referred to above were designed in a particular configuration as will be discussed hereinafter. Applicants found unsatisfactory, existing apparatus for forming the specific corrugations desired, which has resulted in the device of the present invention. More specifically, applicants have invented a device which more adequately conforms sheet metal, preferably aluminum, to a desired shape simply and efficiently, the final shape being determined by a die member which is part of the claimed device.

The present invention can be more adequately appreciated by viewing the following figures in which.

Figure 1:
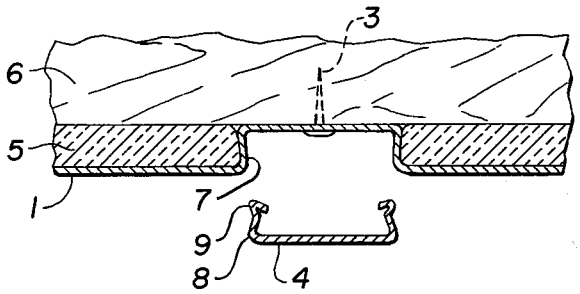
FIG. 1 is an aluminum panel member described and claimed in copending application Ser. No. 749,480, filed Dec. 10, 1976, the corrugation being formed by the device of the present invention.

Referring to the drawings in more detail, FIG. 1 is a cross-section of the aluminum panel strip which is the subject of the copending patent application referred to above. Aluminum exterior wall panel 1 is generally prepainted before installation in any desirable aesthetic pattern. Individual sections of panel are attached to one another and to the exterior surface of an adjacent wall 6 by means of nails 3 or any desirable attachment means such as screws, staples, etc. The aesthetic appearance of these attachment means and the ability of the attachment means to withstand environmental stresses is generally of major importance. However, by using a corrugated channel covered by a prepainted exterior aluminum insert strip 4, any concern as to the aesthetic nature of the attachment means and its ability to withstand environmental stresses are eliminated. The shape of the corrugation and corresponding shape of the U-shaped insert are of importance in the wall fabrication discussed herein. It is desirous to design the insert strip and corrugated channels such that the insert strip can be quickly and easily inserted into the courrugated panel and held snugly without further attachment means. It has been found that this can be most advantageously accomplished by providing an insert strip which is substantially U-shaped having a lip 8 which protrudes slightly wider than the width of the entrance to the corrugated channel and a lip 9 designed to insure a snug contact. The corrugated channel, itself, is substantially U-shaped wherein the side walls of said U-shape slope toward one another to form a channel to receive the aluminum insert strip.

Figure 2:
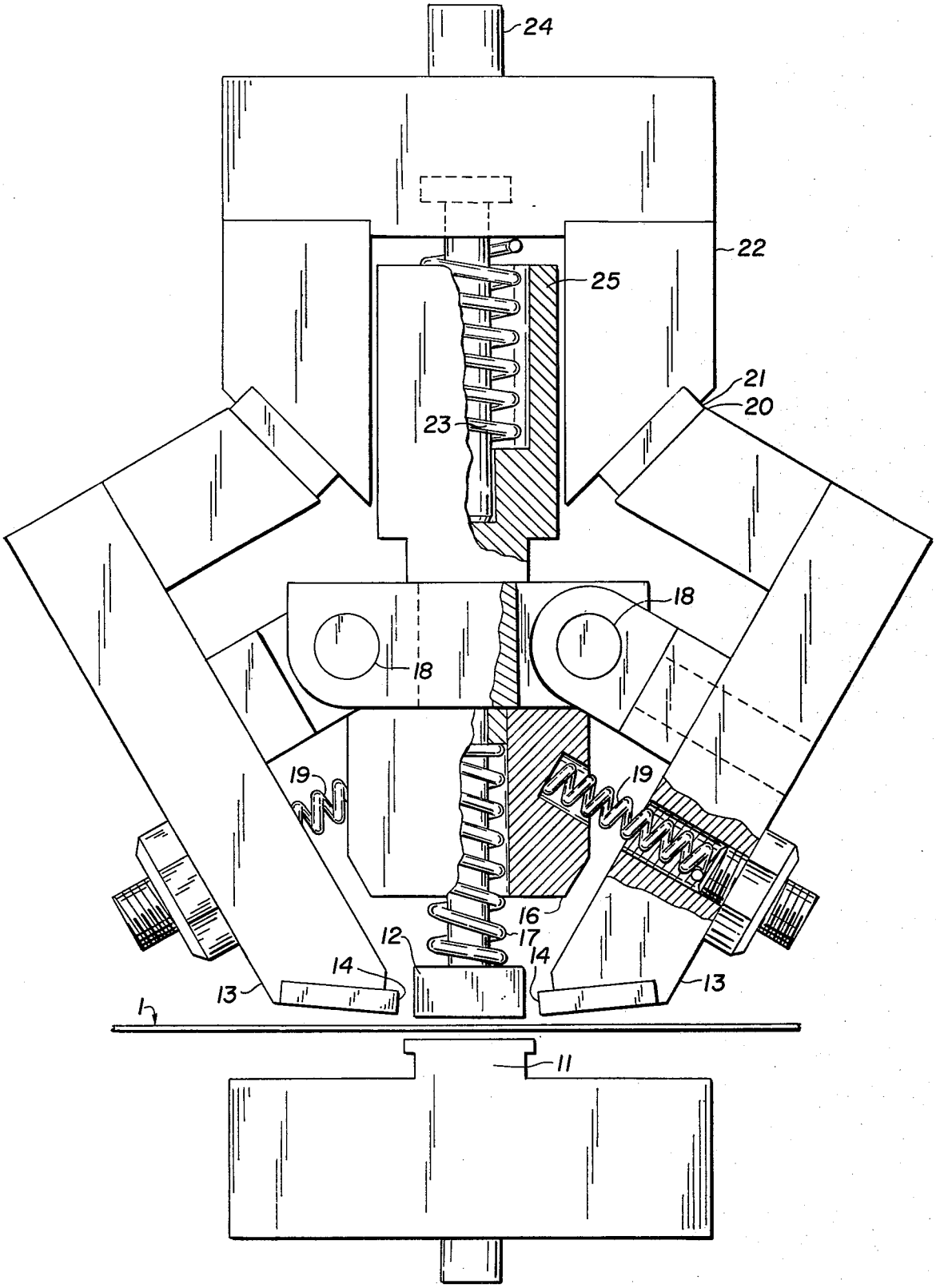
FIG. 2 is a side view of the present invention before actuation.

The corrugated section can be formed quite easily by practicing the present invention which can best be appreciated by viewing FIG. 2. Blank metal sheet 1 is first placed upon die 11 which has been configured to the desired shape for forming the blank metal sheet. Although die 11 is shown to be of a configuration to form channel member 7, this die can be of any desired shape. For the purpose of this disclosure, the invention is described in terms of a device useful in forming the channel of FIG. 1, although the present invention can be used to shape a blank metal sheet to virtually any desirable configuration.

Once blank metal sheet 1 is in place, rod 24 is moved in a downwardly direction driven by means of any desirable actuation system, such as compressed air or other hydraulic system (not shown) and comes into contact with spring 23 which in turn places pressure upon and moves in a downwardly direction, block 25. Block 25 moves independently of block 22 and continues a downward motion upon reaching element 16, hereinafter referred to as the second pressure means. Once elements 25 and 16 are in full contact, second pressure means 16 continues in a downward direction, opposed by spring 17, which ultimately causes means 12, hereinafter referred to as the first pressure means to securedly rest upon blank metal sheet 1.

As can be seen by viewing FIG. 2, arm 13 is pivotally attached to second pressure means 16 at pivots 18. As a means of maintaining crimping means 14 remote from first pressure means 12, springs 19 are channeled into the sides of second pressure means 16 as shown. Naturally, as second pressure means 16 moves in a downwardly direction as described above, crimping means 14 also move closer to blank metal sheet 1 and contact said blank metal sheet at approximately the same instant as first pressure means 12 applies a holding pressure to secure the blank metal sheet to the top surface of die 11 as crimping means 14 captures the blank metal sheet around said die.

Once element 25, and first and second pressure means 12 and 16 have been fully extended, rod 24 acts to lower third pressure means 22 which ultimately actuates crimping means 14 by contacting element 21 at cam 20. At this point, crimping means 14 presses upon the sides of die 11 causing the formation of the desired shape of metal sheet 1.

Figure 3:
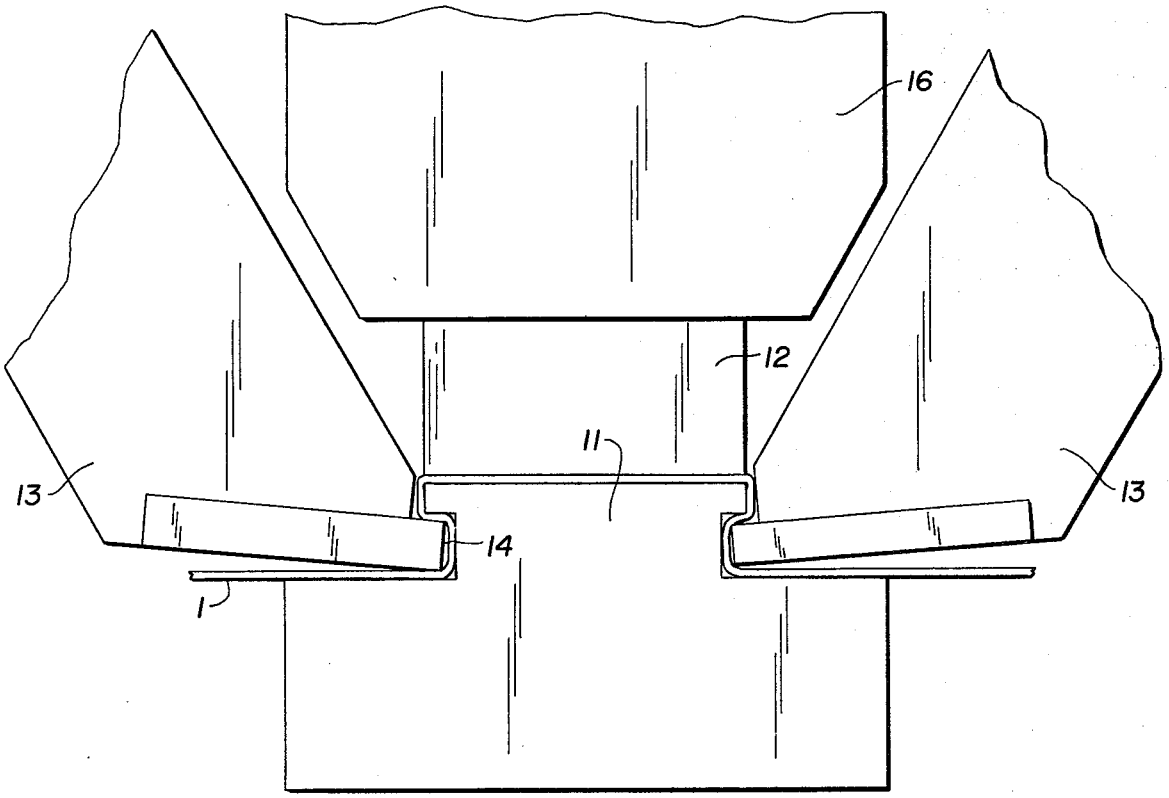
FIG. 3 is a side view of the device of the present invention after the blank metal strip has been conformed to the shape of the die member.

FIG. 3 shows the device of the present invention in which first and second pressure means 12 and 16 have been fully extended and arms 13 have fully pivoted around points 18 to crimp metal sheet 1 about die 11. Once the metal forming step has been carried out, the process is reversed. Thus, third pressure means 22 is first withdrawn causing crimping means to be released from the position shown in FIG. 3. Thereafter, element 25 and second pressure means 16 are raised simply through the expansion of springs 17 and 23 and first pressure means 12 is withdrawn from the formed metal sheet. The metal sheet, now channel shaped, can be removed by causing die 11 to slide away from the remaining assembly while holding metal sheet 1 in place.

This can be accomplished by the use of any suitable pressure means, such as by an hydraulic system (not shown).

Although the metal sheet forming operation has been disclosed as producing the shape shown as defined by die 11, any suitable shape can be reproduced merely by a proper selection of die configuration. The particular shape disclosed has been chosen in order to form aluminum panels as depicted in FIG. 1. However, one of ordinary skill in the art could choose to reproduce metal sheets having other desired configurations while remaining within the scope of the present invention.

What is claimed is:

1. A device for forming a blank metal sheet into a desired shape comprising:

A. die means configured to be of the shape corresponding to the shape of the finally formed metal sheet;

B. a first pressure means for pressing the blank metal sheet against a die;

C. a second pressure means for applying pressure against said first pressure means;

D. crimping means pivotally attached to said second pressure means for conforming said blank metal sheet into its predetermined shape around said die means; and E. a third pressure means for actuating said crimping means after said first and second pressure means have secured said blank metal sheet to said die.

2. The device of claim 1 further characterized such that when said blank metal sheet has been formed to its desired shape, said third pressure means is first released from intimate contact from said cam means thus releasing said crimping means from contact with said metal sheet.

3. The device of claim 2 further characterized such that when said pressure means and crimping means have been withdrawn from said formed metal sheet, the die means is removed from the metal sheet, thus freeing the metal sheet from the die.

* * * * *

UNITED STATES PATENT AND TRADEMARK OFFICE

CERTIFICATE OF CORRECTION

PATENT NO. : 4,091,652

DATED : May 30, 1978

INVENTOR(S) : Clinton H. Wilcox

It is certified that error appears in the above-identified patent and that said Letters Patent are hereby corrected as shown below:

Column 4, line 9, (at the end of claim 1) after "die" insert ---by coacting cam means attached to arms pivotally attached to said crimping means---.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*